US006182932B1

(12) United States Patent
Weber

(10) Patent No.: US 6,182,932 B1
(45) Date of Patent: Feb. 6, 2001

(54) FLEXI-RAIL ASSEMBLY

(75) Inventor: Darrell Dwaine Weber, Glendale, AZ (US)

(73) Assignee: CE Nuclear Power LLC, Windsor, CT (US)

( * ) Notice: Under 35 U.S.C. 154(b), the term of this patent shall be extended for 0 days.

(21) Appl. No.: 09/287,366

(22) Filed: Apr. 7, 1999

(51) Int. Cl.[7] ..... A47B 96/06; E04G 3/00; F16B 1/00; G09F 7/18; G01F 7/18; G01V 5/00

(52) U.S. Cl. ..... 248/230.1; 376/249; 248/647

(58) Field of Search ..... 376/245, 249, 376/244; 248/230.1, 226.11, 647, 646

(56) References Cited

U.S. PATENT DOCUMENTS

| | | | | |
|---|---|---|---|---|
| 4,174,999 | * | 11/1979 | Burns | 176/19 |
| 4,222,540 | | 9/1980 | King et al. . | |
| 4,507,260 | * | 3/1985 | Fujimoto et al. | 376/249 |
| 4,643,472 | | 2/1987 | Schukei et al. . | |
| 5,201,281 | * | 4/1993 | Cella | 376/249 |
| 5,271,046 | * | 12/1993 | Dirauf et al. | 376/249 |
| 5,784,425 | * | 7/1998 | Morlan | 376/249 |
| 5,844,956 | * | 12/1998 | Schramm et al. | 376/249 |
| 5,864,595 | * | 1/1999 | Burrows et al. | 376/249 |
| 5,878,099 | * | 3/1999 | Burrows et al. | 376/260 |

FOREIGN PATENT DOCUMENTS

| | | |
|---|---|---|
| 2443016 | 6/1980 | (FR) . |
| 2559090 | 8/1985 | (FR) . |
| 2595502 | 9/1987 | (FR) . |

* cited by examiner

*Primary Examiner*—Anita M. King
*Assistant Examiner*—Jerome DeLuca
(74) *Attorney, Agent, or Firm*—Henry T. Crenshaw; Ronald P. Kananen; Rader, Fishman & Grauer

(57) ABSTRACT

A flexi-rail assembly for supporting and positioning tools for inspecting a nuclear power plant steam generator. The flexi-rail assembly includes a housing; at least one lock assembly carried by the housing for coupling the housing to a support structure; and a carriage assembly movably supported by the housing for supporting and positioning inspection tools such as a robot manipulator arm and leg assembly. The housing includes a hollow rear portion for receiving at least one cylinder supporting a movable surface, wherein the cylinder is coupled to a source of pressurized fluid. The housing also supports at least one recessed surface for receiving the lock assembly. The lock assembly includes the cylinder and at least one tubular member. The tubular member includes an open center and at least two openings formed in the surface of the tubular structure. The carriage assembly includes a first surface supporting a plurality of outwardly projecting cylindrical members for coupling the carriage assembly to the housing; a second surface carried by the first surface, the second surface supporting a plurality of cylindrical members for coupling the carriage assembly to the housing; and a third surface movable relative to the second surface, the third surface supporting a locking assembly for securing the third surface to the housing.

19 Claims, 7 Drawing Sheets

FLEXI-RAIL ASSEMBLY

FIELD OF THE INVENTION

This invention relates generally to an apparatus for use in performing inspections of a nuclear power plant steam generator. More particularly, the invention relates to a moveable apparatus that supports an anchored leg and a robot arm for inspecting a nuclear power plant steam generator, wherein the device automatically or manually repositions the manipulator arm.

BACKGROUND OF THE INVENTION

Steam generator (S/G) inspections and repairs are a major component of the aging commercial pressure water reactor (PWR) nuclear industry refueling outage duration. As power producers enter the deregulated market, the need to shorten outage duration, dose and cost is more important than ever. Steam generator inspections are a high-end technology, which is constantly changing, and are a major portion of each unit's outage cost. The work occurs in the primary system, which is one of the highest radiation areas in the plant. The speed at which a S/G inspection is conducted is critical to decreasing the outage duration, dose and cost. These metrics are used by the nuclear industry to measure efficiency, planning, compliance and control during outages.

Existing S/G inspection systems include a leg anchored to a tube sheet. The leg provides vertical motion for a three-axis arm to facilitate the required inspections and repairs. During S/G inspections, the manipulator arm must be repositioned relative to the S/G plenum to access the entire surface of the tube. This repositioning of the manipulator arm adds time, dose and significant preplanning to minimize the number of moves required during the inspection/repair campaign.

Generally, two platform workers located outside the S/G reposition the manipulator arm using a block and tackle and long poles. Whenever the manipulator is repositioned, the potential for robot damage is significantly increased due to the fact that the manipulator arm must be removed from the S/G plenum prior to repositioning and re-installed after repositioning is complete. Additionally, during an inspection, it is vital to maintain the arm parallel with the tube sheet for proper operation of various tooling. Frequently, platform workers are required to straighten the leg during repair activities to keep the arm straight.

Consequently, there is a need for a S/G inspection system that permits repositioning of a S/G manipulator arm without having to remove the arm from the anchored leg. Additionally, there is a need for a S/G inspection system that facilitates repositioning both the anchored leg and manipulator arm relative to the S/G.

SUMMARY OF THE INVENTION

In overcoming the shortcomings of the prior art systems, a main object of the invention is to provide a flexi-rail assembly that includes a housing; at least one lock assembly carried by the housing for coupling the housing to a support structure; and a carriage assembly movably supported by the housing for supporting and positioning inspection tools such as a robot manipulator arm and leg assembly.

The housing is generally mounted on a stay cylinder, and thus the surfaces forming the housing have a slight curvature to permit the housing to rest substantially flush with the stay cylinder; however, a small gap between housing and the stay cylinder is not detrimental to the operation of the flexi-rail assembly. The housing includes a hollow rear portion for receiving at least one cylinder supporting a movable surface, wherein the cylinder is coupled to a source of pressurized fluid. The housing also supports at least one recessed surface for receiving the lock assembly.

The lock assembly includes the cylinder (discussed above) and at least one tubular member. The tubular member includes an open center and at least two openings in the surface tubular structure. The lock assembly also includes a shaft received in the open center, the shaft defining at least two recessed surfaces. Each recessed surface supports at least one ball sized to be received in the openings defined by the tubular member, wherein a portion of each ball contacts a portion of the shaft and an adjacent external surface when received in the openings. This arrangement couples the housing to the external surface when the balls are forced off the recessed surfaces and into the openings defined by the tubular member. This action wedges the balls between the shaft and the external surface.

The carriage assembly includes a first surface supporting a plurality of outwardly projecting cylindrical members for coupling the carriage assembly to the housing; a second surface carried by the first surface, the second surface supporting a plurality of cylindrical members for coupling the carriage assembly to the housing; and a third surface movable relative to the second surface, the third surface supporting a locking assembly for securing the third surface to the housing.

Specifically, the flexi-rail assembly includes an apparatus for supporting and positioning tools for inspecting a nuclear power plant steam generator. The apparatus includes a housing; at least one tube lock assembly carried by the housing for coupling the housing to a tube sheet, and a carriage assembly.

The housing includes front, rear, top, bottom, and side wall surfaces. The housing has a slightly curved surface, and supports a cylinder (discussed below) which forms part of the lock assembly.

The tube lock assembly includes the cylinder (discussed above) and three locking members. The cylinder supports a movable surface, and is coupled to a source of pressurized fluid using known techniques. As the pressurized fluid enters the cylinder, the movable surface extends. A link, an elongated member, couples the movable surface to the tube locking members.

Each tube locking member is a tubular structure having an open center and at least two openings formed in the surface of the tubular member. A shaft is received in the open center of the tubular structure. The shaft defines at least two recessed surfaces, each recessed surface supporting at least one ball sized to be received in the openings defined by the tubular member. The balls rest in the openings such that a portion of each ball contacts a portion of the shaft and an adjacent surface of the tube sheet when received in the openings. This arrangement couples the housing to the tube sheet when the balls are forced off the recessed surfaces and into the openings defined by the tubular member, wherein each ball is wedged between the shaft and the adjacent surface of the tube sheet surface.

The engagement between the shaft, balls and the tube sheet is reinforced by a spring pressure. The shaft is coupled to a spring for inducing a downward load on the shaft, forcing the balls to remain in the openings and wedged against the shaft and the external surface.

The apparatus also includes a carriage assembly movably supported by the housing for supporting and positioning inspection tools. The carriage assembly includes a first surface supporting a plurality of outwardly projecting cylindrical members for movably coupling the carriage assembly to the housing; a second surface carried by the first surface, the second surface supporting a plurality of cylindrical members for movably coupling the carriage assembly to the housing; and a third surface movable relative to the second surface, the third surface supporting a block locking assembly for securing the third surface to the housing.

The block locking assembly includes a plurality of tubular members retained in a block housing, the tubular members being coupled to a source of pressurized fluid; and a ball-detent system retained by each tubular member. The ball-detent system is identical to that previously described, and thus includes a tubular member having an open center and at least two openings in the surface of the tubular member; and a shaft received in the open center. The shaft has at least two recessed surfaces formed in opposite faces. Each recessed surface supports at least one ball sized to be received in the openings defined by the tubular member. A portion of each ball contacts a portion of the shaft and the housing when received in the openings, whereby the locking assembly couples the carriage assembly to the housing when the balls are forced off the recessed surfaces and into the openings defined by the tubular member. This action causes each ball to become wedged between the shaft and the housing.

Lastly, the flexi-rail assembly includes a foot supported by an anchored leg carried by the flexi-rail assembly. The foot keeps the leg level during inspection and repair of the steam generator.

BRIEF DESCRIPTION OF THE DRAWINGS

The features and inventive aspects of the present invention will become more apparent upon reading the following detailed description, claims and drawings, of which the following is a brief description:

DESCRIPTION OF THE PREFERRED EMBODIMENT

Figure 1:
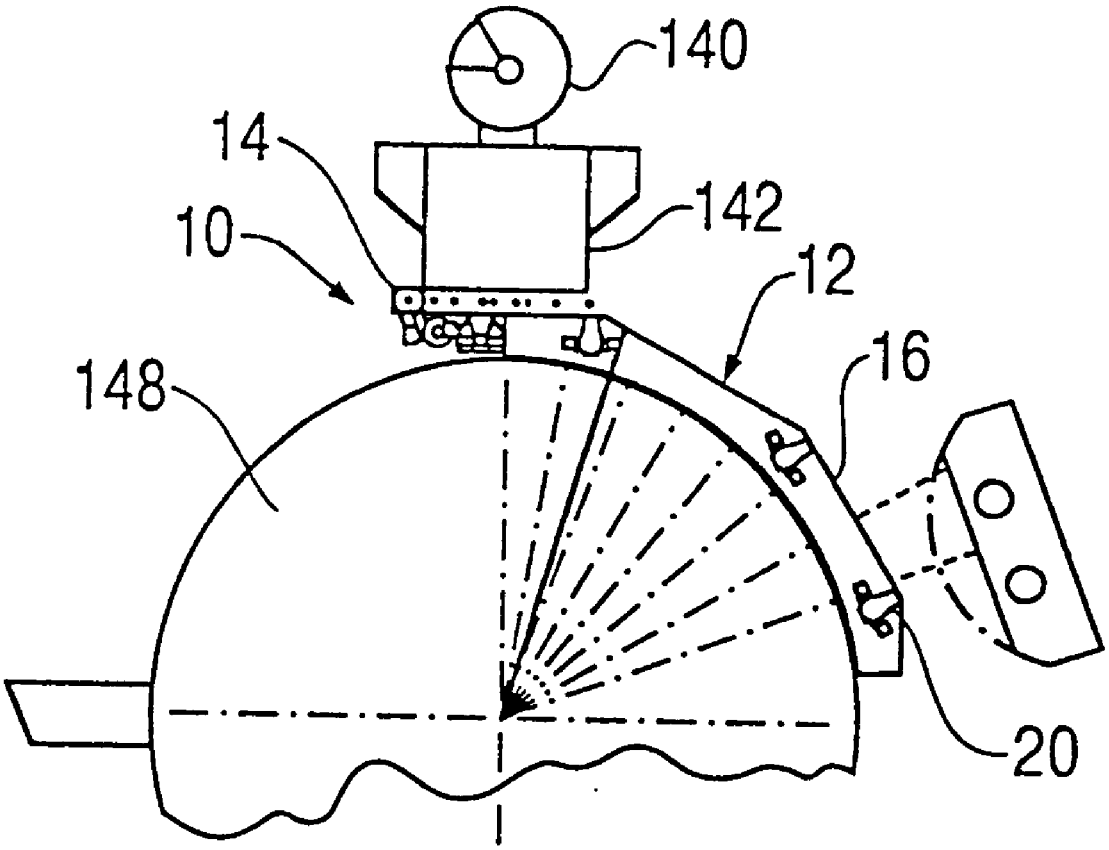
FIG. 1 is an illustration of a flexi-rail assembly formed according to the invention, wherein the flexi-rail assembly is shown installed on a stay cylinder and supporting a manipulator arm for inspecting a steam generator of a nuclear power plant.

FIG. 1 shows a flexi-rail assembly 10 formed in accordance with the teachings of the present invention. The elements of this invention include several common features. It will be understood that common reference numerals are used to describe common features of the invention.

The flexi-rail assembly 10 is fabricated using aluminum primarily with some stainless steel structural components. It will be appreciated that other materials having similar mechanical and corrosion resistant properties may be used. The flexi-rail assembly 10 supports a robot arm manipulator 140 used during inspection and repair of a steam generator (S/G) of a nuclear power plant. The flexi-rail assembly 10 includes a flexi-rail 12 and a carriage assembly 14.

Figure 2:
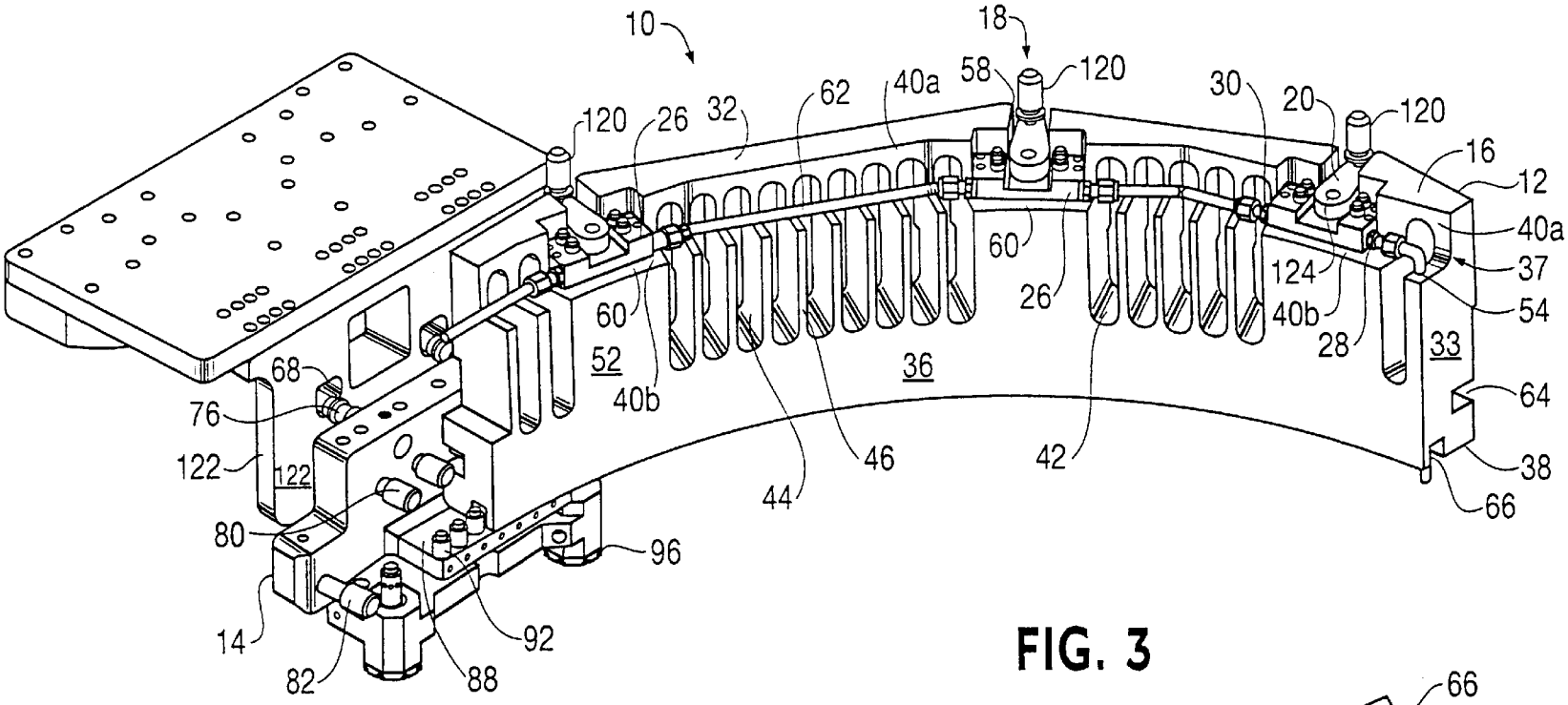
FIG. 2 is a detailed view of a portion of an inner circumference of the flex-rail assembly of FIG. 1.
Figure 4:
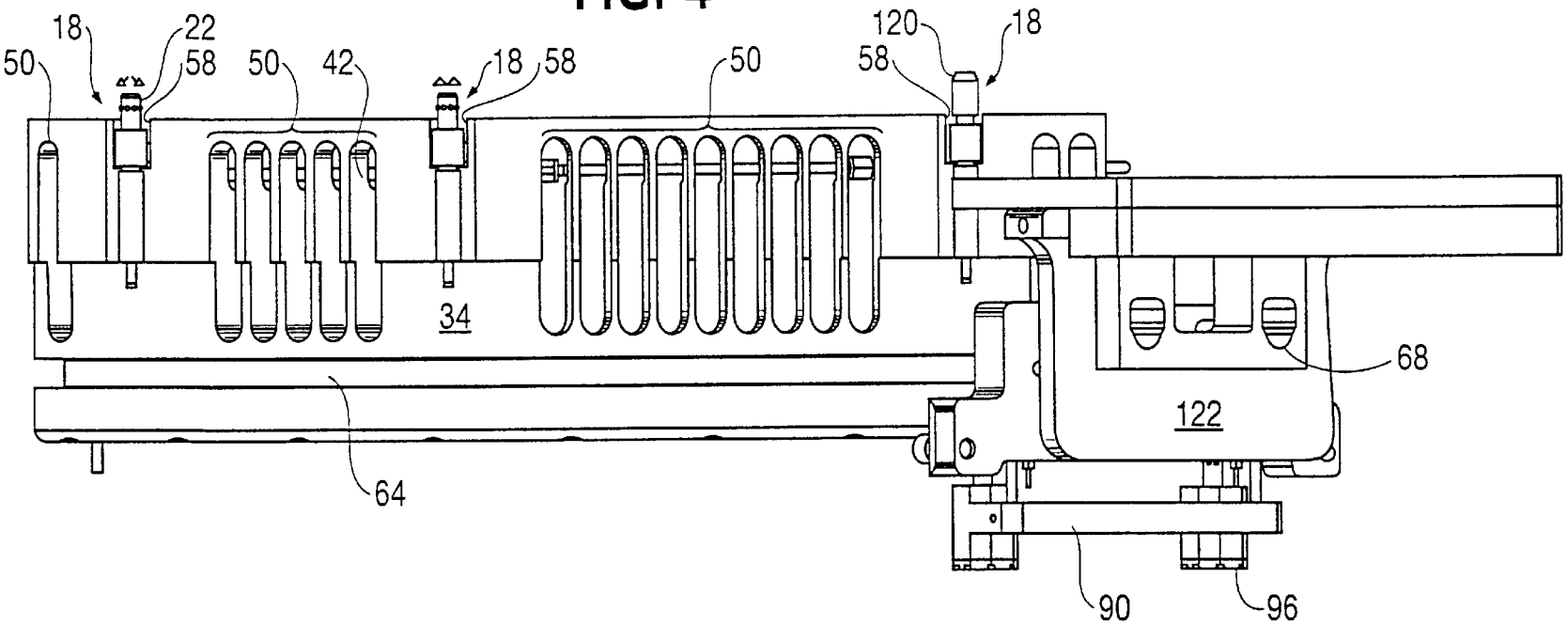
FIG. 4 is a detailed view of a portion of an outer circumference of the flexi-rail assembly of FIG. 1, showing the carriage assembly supporting the anchor plate.
Figure 5:
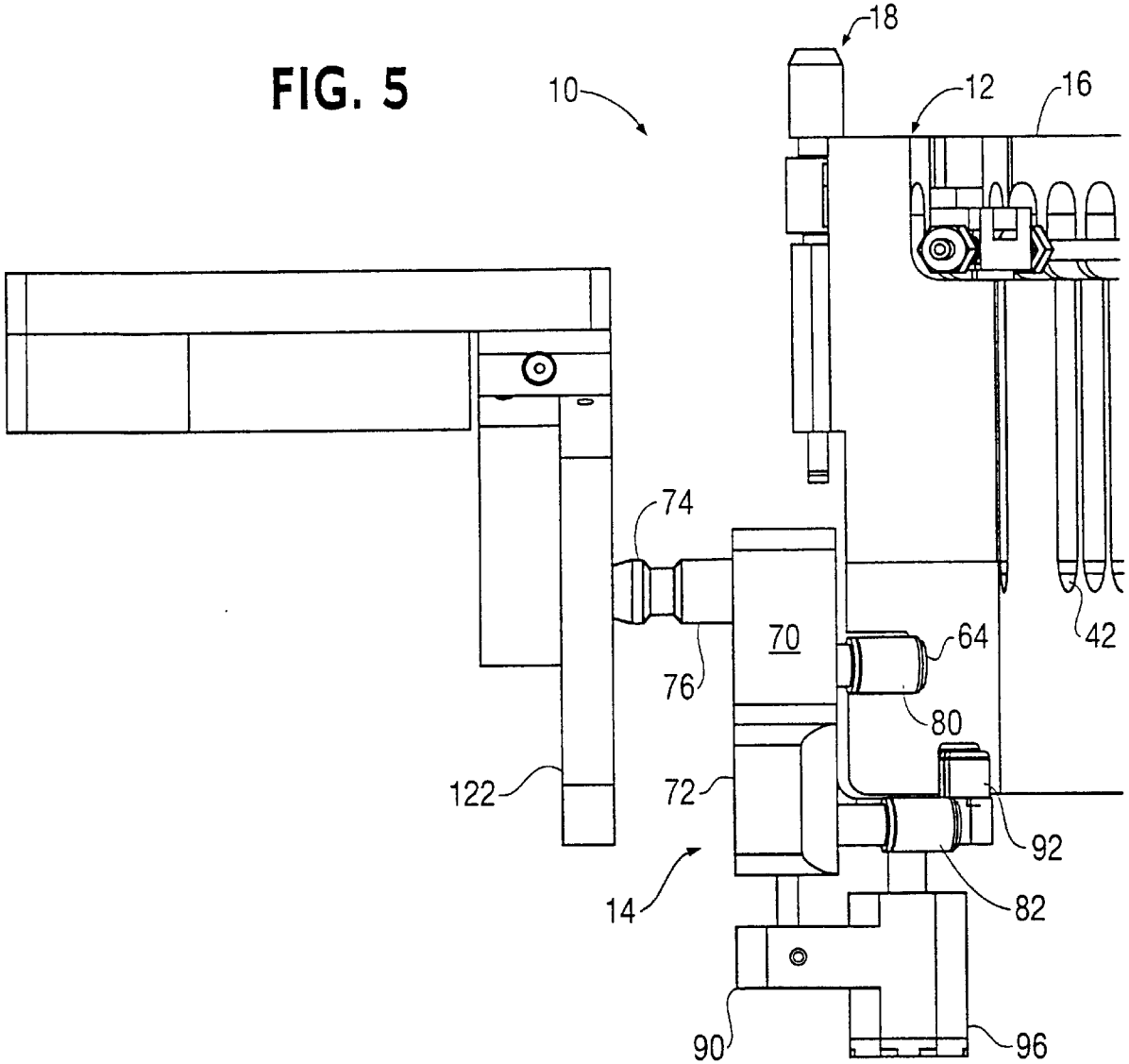
FIG. 5 is a elevational view of the flexi-rail assembly shown in FIG. 1, wherein the carriage assembly is shown supporting a mounting plate.

As illustrated in FIGS. 2 and 5, the flexi-rail 12 includes a housing 16 and a tube sheet locking assembly 18. The housing 16 is an enclosed rectangularly shaped structure including a top surface 32, a front surface 34 (FIG. 4), a rear surface 36, a bottom surface 38, and side walls 33. In the embodiment shown, the housing 16 is formed having a slight curvature, wherein the curvature is sized to permit the housing 16 to rest flush against a stay cylinder 148 (FIG. 1) onto which the housing 16 is mounted.

The front surface 34 has a stepped configuration, wherein the top portion slightly overhangs the bottom portion. The bottom portion supports a rectangularly shaped groove 64 that extends horizontally along the length of the front surface 34. Positioned above the groove 64 are three recessed surfaces 58, which extend upwardly into a portion of the top surface 32. As shown in FIGS. 2 and 4, the two end recessed surfaces 58 are located approximately an equal distance from each side wall 33 and the third recessed surface 58 is positioned therebetween.

Figure 6:
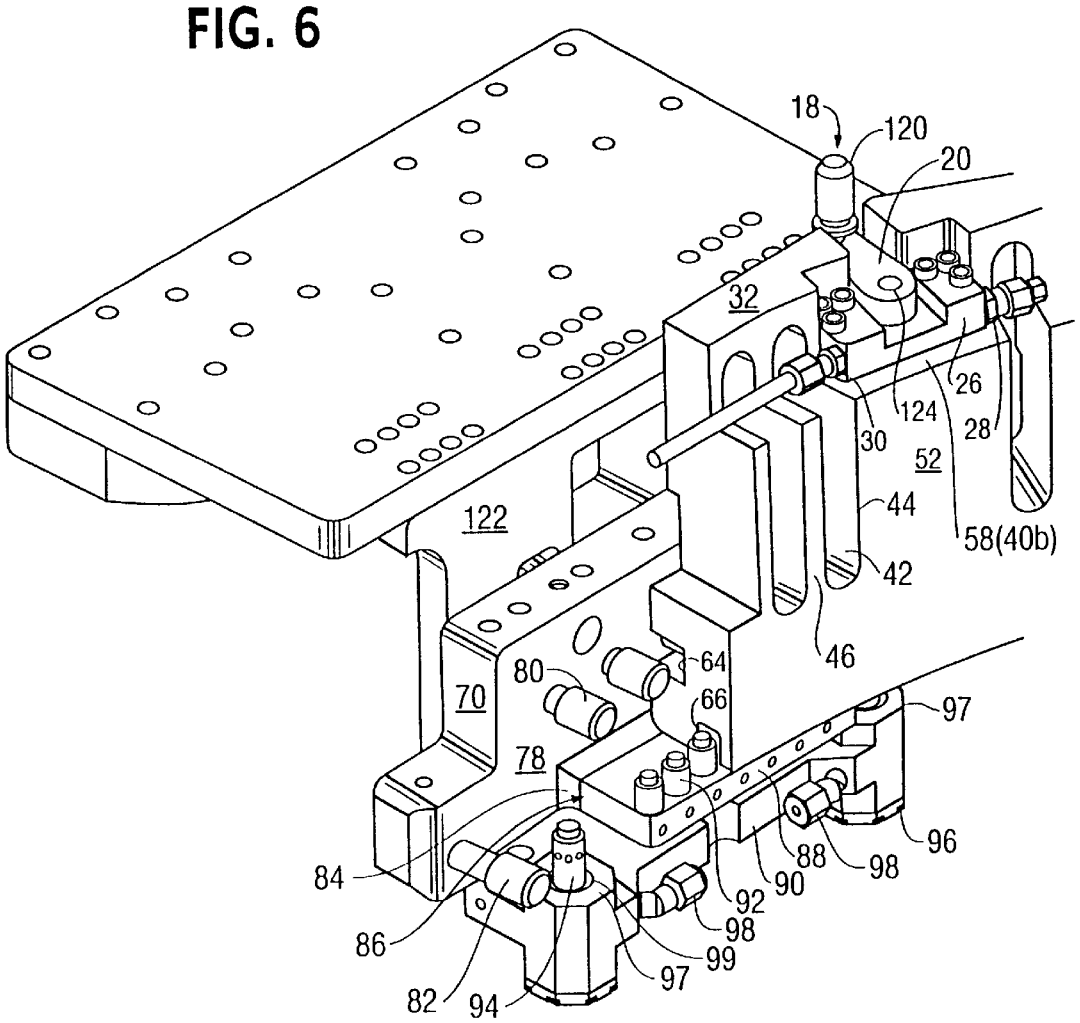
FIG. 6 is a detailed view of the flexi-rail assembly of FIG. 2, showing the fluid connector coupled to the lower plate.

Adjacent each recessed surface 58 is a plurality of elliptically shaped slots 42 extending vertically along a portion of the front surface 34. One function of the slots 42 is to help reduce the weight of the flexi-rail assembly 10. As shown in FIGS. 2, 5 and 6, the slots 42 are clustered in groups 50 containing one or more slots 42. At least one group 50 is positioned in the front surface 34 adjacent each recessed surface 58.

As shown in FIGS. 2 and 6, side walls 44 surround the slots 42. Flat plates 46 extend outwardly forming the side walls 44 and toward the rear of the housing 16. The rear portion of the flat plates 46 is flush with the rear surface 36.

Figure 7:
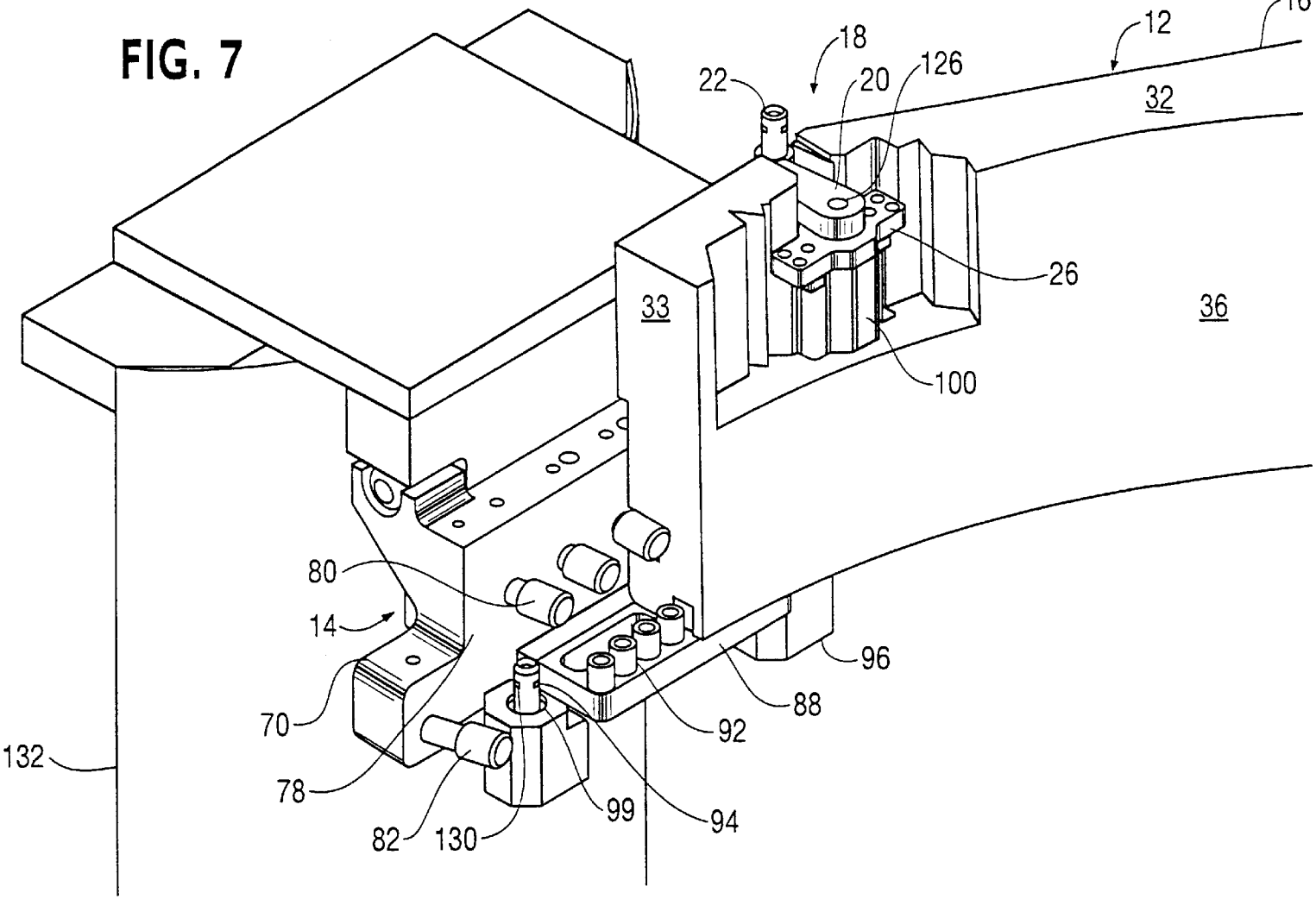
FIG. 7 is a sectional view of the flexi-rail assembly of FIG. 6, showing a portion of the rear wall surface removed.

The rear surface 36 includes an upper L-shaped portion 60 having an upwardly extending surface 40a and a horizontal rearwardly extending surface 40*b*. The rear surface 36 also includes a plurality of hollow rear wall portions 52 extending downwardly from the portion 60 so as to separate each group 50. As illustrated in FIG. 7, the hollow center of each rear wall portion 52 retains a spring-loaded cylinder 100 that forms part of the tube lock assembly 18 (discussed below).

Figure 8:
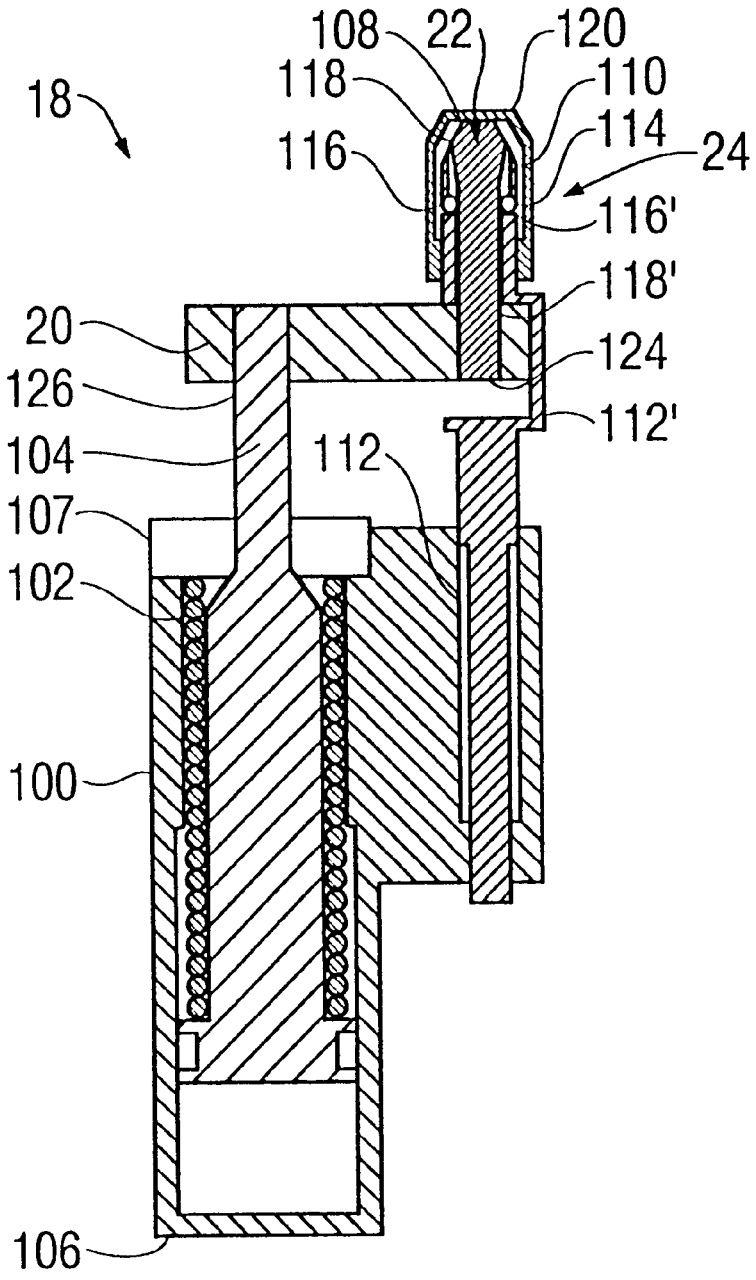
FIG. 8 is a sectional view of the flexi-rail assembly of FIG. 2, showing the cylinder and tube lock assembly.

As shown in FIG. 8, the tube lock assembly 18 includes a cylinder 100 and three locking members 22. The cylinder 100 includes a lower end 106 coupled to a source of pressurized fluid and an upper end 107, which supports a movable piston 104. As pressurized fluid enters the cylinder 100, the piston 104 extends. A spring 102 is coupled to the cylinder 100 using known techniques. The spring 102 causes retraction of the cylinder 100 once the pressure source is deactivated. In the embodiment described, the source of pressurized fluid is a hydraulic pump. One of ordinary skill in the art will appreciate that the hydraulic pump may be replaced by a pneumatic source or another energy source that supplies a force of sufficient magnitude that causes extension of the piston 104.

The cylinder 100 is coupled to the pressure source (not shown) at the lower end 106 via hydraulic tubing 62 (FIG.

2). As shown in FIG. 2, one end of the tubing 62 is secured to the flexi-rail 12 in an opening 54 defined by the surface 40*b* at the side wall surface 33. The other end of the tubing 62 extends between each rear wall portion 52, and is coupled to each hydraulic cylinder 100 through inlet and outlet openings 28, 30 (FIG. 6). The tubing 62 is coupled to each cylinder 100 so as to form a serially connected hydraulic circuit.

As shown in FIG. 6, the inlet and outlet openings 28, 30 are formed in the mounting plate 26. The mounting plate 26 is a U-shaped member received in the portion of the recessed surface 58 formed in the top surface 32. The mounting plate 26 rests on the surface 40*b*, wherein mechanical fasteners such as a nut and bolt combination couple the mounting plate 26 to the surface 40*b*. It will be appreciated that other commonly known fastening means may be used.

As shown in FIGS. 8 and 6, at the upper end 107, the piston 104 is coupled to a link 20. The link 20 is an elongated member supported by the mounting plate 26 such that the length of the link 20 extends toward the front surface 34. The upper end of the piston 104 is received in an opening (not shown) formed in the mounting plate 26 and a mating opening 126 formed near the front portion of the link 20. As shown in FIG. 7, the opening 126 in the link 20 is aligned with the opening in the mounting plate 26. The upper end of the piston 104 is received in the aligned openings, mounting plate opening and the opening 126. The mounting plate 26, piston 104 and link 20 are coupled together using conventional fastening means such as mating threads, pin connectors, etc.

The link 20 provides a means for coupling the piston 104 to the tube locking members 22, as the proximate end of the link 20 defines a second opening 124 for receiving one of the tube locking members 22. It will be appreciated that the other tube locking members 22 are each received in separate openings 124.

As shown in FIG. 8, the tube locking members 22 couple the flexi-rail 12 to the tube sheet during inspection and repair of the S/G. Each tube locking member 22 includes a shaft 108 received in a cylindrical tube 110 and a spring 112. The shaft 108 has a tapered surface having a recessed portion such that the upper end 118 is wider than the main body 118' of the shaft 108. The cylindrical tube 110 includes openings 116, 116' formed in opposite surfaces. Each opening 116, 116' receives a ball 114. Each ball 114 rests in the openings 116, 116', abutting the recessed portion of the shaft 108. The spring 112 is positioned below the cylindrical tube 110 and coupled thereto via a case 112'. The case 112' is an elongated rigid member that is not easily deformed upon compression of the spring 112.

Together, the shaft 108, cylindrical tube 110 and the spring 112 create a detent locking system 24 that couples the tube locking members 22 to the tube sheet. To secure the tube locking members 22 to the tube sheet, a pressurized fluid is directed into the cylinder 100 via tubing 62, causing extension of the piston 104. As the piston 104 extends, the shaft 108 is raised, causing the balls 114 to rest against the narrow portion 118' of the shaft 108. When the hydraulic pressure is released, the opposing force of the spring 102 causes the piston 104 to retract, thus causing the shaft 108 to retract. Upon retraction of the shaft 108, the wide portion 118 of the shaft 108 forces the balls 114 into the openings 116, 116' formed in the tube 110. The balls 114 are wedged against the shaft 108 and the tube sheet rod 120, thus frictionally coupling the shaft 108 and the tube sheet rod 120 together. To ensure a continued downward force on the shaft 108 and the balls 114, the spring 112 grabs the end of the shaft 108 as the shaft 108 is retracted. The spring 112 induces a downward force on the tube 110, ensuring continued contact between the wide portion 118 of the shaft 108 and the balls 114.

Figure 3:
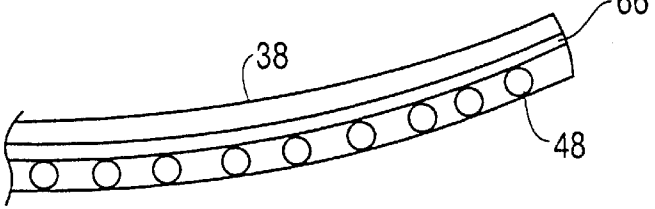
FIG. 3 is a bottom view of the flexi-rail portion of the flexi-rail assembly shown in FIG. 2.

Turning now to a discussion of the bottom surface 38, the bottom surface 38 defines a rectangularly shaped groove 66 extending horizontally along the length of the bottom surface 38, as illustrated in FIGS. 2 and 3. The bottom surface 38 also defines a plurality of circular openings 48.

FIGS. 5 and 6 show an embodiment of the carriage assembly 14. As best seen in FIG. 1, the carriage assembly 14 is movably supported by the flexi-rail 12, and provides the supporting surface for the anchored leg 142 and the manipulator arm 140. As shown in FIGS. 5 and 6, the carriage assembly 14 is a rectangularly shaped structure having a stepped side wall surface 70, a front surface 72 and a rear surface 78.

The front surface 72 supports outwardly projecting locking lugs 76. The locking lugs 76 are cylindrically shaped tubes retaining a movable piston. The distal end of each locking lug 76 includes a raised surface 74 that couples the locking lugs 76 to an anchor plate 122. As shown in FIG. 2, the proximate ends of the locking lugs 76 are received in a key hole shaped opening 68 formed in the anchor plate 122. Once the raised surface 74 is inside the key hole shaped opening 68, the smaller diameter of the lug 76 permits the locking lug 76 to slide down into the key hole shaped opening 68 such that the edges of the raised surface 74 are trapped behind the edges of the smaller portion of the key hole opening 68. A hydraulic pressure is applied to the opposite end of each locking lug 76, causing the movable piston to retract. This action drives the raised surface 74 into contact with the smaller portion of the key hole shaped opening 68, creating a locking arrangement that holds the locking lugs 76 against the surface area surrounding the key hole shaped opening 68.

The rear surface 78 supports a plurality of guide rollers 80, which are received in and rotate freely about the groove 64 defined in the front surface 34 of the housing 16. The guide rollers 80 are positioned along the carriage assembly 14 in a configuration that coincides with the curvature of the of the flexi-rail 12. The guide rollers 80 are sized, relative to the groove 64, such that the rollers 80 only fit into the groove 64 at the edge portion of the groove 64 defined in the side walls 33. Further, the rollers 80 are sized to prevent the rollers 80 from tilting up and sliding out the front portion of the groove 64.

Additionally, the rear surface 78, shown in FIG. 6, supports two outwardly extending tilt rollers 82 that track along the bottom of the flexi-rail 12 when the carriage assembly 14 is installed thereon. The rear surface 78 also supports a mounting plate 84. The mounting plate 84 in turn supports a surface 86 that extends outwardly from the mounting plate 84. The surface 86 includes a rectangularly shaped upper plate 88 and a movable lower plate 90. The upper plate 88 projects outwardly from the mounting plate 84, and has a length that extends horizontally along the length of the mounting plate 84. As best seen in FIG. 2, the upper plate 88 supports a plurality of radial rollers 92 received in the groove 66 defined by the bottom surface 38 of the housing 16. The radial rollers 92 are positioned along the carriage assembly 14 in an arrangement that matches the curvature of the flex-rail 12. The radial rollers 92 are sized to rotate freely relative to groove 66.

The lower plate 90 is a rectangularly shaped surface movably coupled to the mounting plate 84. The lower plate 90 is coupled to a source of pressurized fluid (not shown). When the lower plate 90 receives the pressurized fluid, the plate moves upward into contact with the upper plate 88. This action causes the compression of a spring (not shown) supported by the lower plate 90, and when the fluid pressure is released, the recoiling force of the spring causes the lower plate 90 to move away from the upper plate 88. In the embodiment described, the source of pressurized fluid is a hydraulic pump (not shown). It will be appreciated that the hydraulic pump may be replaced with a pneumatic pump or another source of energy that supplies a force of sufficient magnitude to lift the lower plate 90.

Additionally, the lower plate 90 includes an upper edge 97 that defines a locking block housing 96. A locking block housing 96 is located in each corner of the upper edge 97. As shown in FIG. 6, each locking block 96 has a central opening 99 that receives a locking lug 94. The locking lugs 94 are cylindrically shaped elongated members. Each locking lug 94 is in fluid communication with a connector 98 supported by the block housing 96. When a pressurized fluid is applied to the locking lugs 94, a ball-detent lock of the type previously described for the tube lock assembly 18 is activated.

In forming the ball-detent lock, each locking lug 94 includes an arrangement similar to that of the locking member 22 shown in FIG. 8. Namely, each locking lug 94 includes a shaft 108 received in a cylindrical tube 110. The shaft 108 has a tapered surface, wherein the upper end 118 is wider than the main body 118' of the shaft 108. The cylindrical tube 110 includes openings 116, 116' formed in opposite surfaces. Each opening 116, 116' receives a ball 114. Each ball 114 rests in the opening 116, 116', abutting the narrow portion 118' of the shaft 108.

When a pressurized fluid is directed to the locking lugs 94 via the connectors 98, the shaft 108 moves downward in the cylindrical tube 110. As the shaft 108 moves downward, the wide portion 118 contacts the balls 114, causing the balls 114 to move into the openings 116, 116' formed in the tube 110. This action wedges the balls 114 against the shaft 108 and an interior surface of the block housing 96, thus creating a frictional lock that secures the locking lugs 94 in position.

Figure 9:
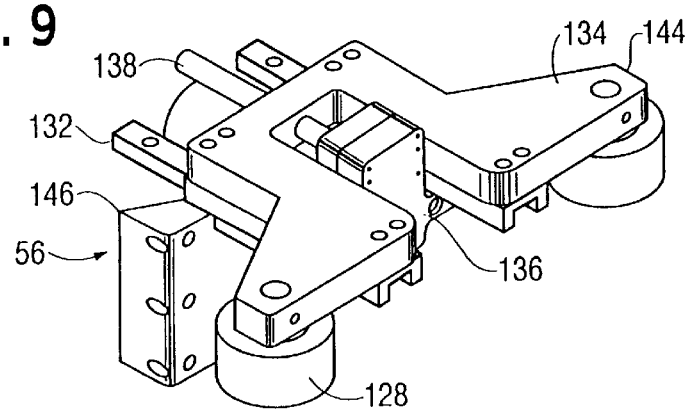
FIG. 9 is a perspective view of the foot assembly that is coupled to the leg for keeping the leg straight during a S/G inspection.

Finally, as shown in FIG. 9, the flexi-rail assembly 10 also includes a foot 56 coupled to the leg 142 for keeping the leg 142 level as the carriage assembly 14 moves along the flexi-rail 12. The foot 56 includes a mounting bracket 146 that couples the foot 56 to the leg 142 using conventional techniques. The foot 56 also includes a secondary mounting system that includes a guide rail 132 having a U-shaped center portion for coupling to a mating guide (not shown) supported by the leg 142. The guide rail 132 is secured to the leg 142 using known techniques.

Additionally, the mounting bracket 146 supports a flat top surface 134 that projects horizontally outward from the bracket 146. The top surface 134 includes outwardly projecting flanges 144 that support alignment wheels 128 for contacting the stay cylinder 148. As the carriage assembly 14 traverses the flexi-rail 12, the alignment wheels 128 track along the stay cylinder 148, permitting the leg 142 to move with the carriage assembly 14.

Occasionally, the leg 142 will become misaligned during travel along the flexi-rail 12. The foot 56, thus, includes an alignment pad 136 coupled to an alignment rod 138. The alignment rod 138 is coupled to an energy source such as a hydraulic, pneumatic or electrical source using known techniques. When the leg 142 becomes misaligned, a force is applied to the alignment rod 138 that causes the alignment pad 136 to push against the stay cylinder 148. This action causes small adjustments in the position of the leg 142, causing realignment of the leg 142 so that the arm 140 remains parallel with the tube sheet during the S/G inspection cycle.

As noted above, the apparatus of the present invention is formed primarily of aluminum with some components being preferably formed of stainless steel. The components preferably of stainless steel are the rollers 92 (e.g., FIG. 2), the mounting plate 26 (FIGS. 2 and 6), the link 20 (FIGS. 2, 6 and 8), inlet and outlet opening fixtures 28, 30 (FIG. 6), and tube sheet rod 120 (FIG. 8).

ASSEMBLY

The housing 16 and the carriage assembly 14 require no tools for assembly. The assembly requires inserting the guide rollers 80 into the groove 64 formed in the front surface 34 of the housing 16. This arrangement also permits the radial rollers 92 to be received in groove 66 formed in the bottom surface 38 of the housing 16.

When the lower plate 90 is in the down position, the carriage assembly 14 traverses the length of the housing 16 by causing rotation of the rollers 80 and 82. When the lower plate 90 is in the up position, the carriage assembly is positioned such that each locking lug 94 is received in separate openings 48 formed in the bottom surface 38, and the tilt rollers 82 abut the bottom surface 38 and track along bottom surface 38 when the carriage assembly 14 is in motion. The carriage assembly 14 and the housing 16 are held in contact by frictional engagement of the rollers 80, 92 in slots 64 and 66 formed respectively the front surface 34 and the bottom surface 38.

Additionally, the carriage assembly 14 and the housing 16 are pneumatically coupled together. The locking lugs 94 are in fluid communication with a source of air pressure received by the connectors 98. When the lower plate 90 is in the up position and the locking lugs 94 are received in the openings 48, a source of pressurized air directed to the locking lug 94 activates the ball-detent system. The pressurized air forces the balls off of the detents and into the openings 130, wedging the balls against the surface surrounding the opening 48. This arrangement secures the locking lugs 94 to the flexi-rail 12.

INSTALLATION ON S/G AND ATTACHMENT OF MANIPULATOR

Using block and tackle and long poles, platform workers located outside the S/G couple the flexi-rail 12 to the stay cylinder 148 tube sheet by inserting the tube locking members 22 into mating openings formed in the tube sheet. Long poles and tethers balance the flexi-rail 12 while the workers connect the pressure source to the end of the tubing 62. Once the pressure source is connected, the hydraulic system is activated, causing the tube locking members 22 to engage the tube sheet in the manner previously described.

Next, the carriage assembly 14 is coupled to the flexi-rail 12. The lower plate 90 is in the down position, and the guide rollers 80 are guided into the groove 64 at either edge of the groove 64 defined in the side wall surfaces 33. Simultaneously, radial rollers 92 are inserted into the groove 66 at either edge of the groove 66 defined in the side wall surfaces 33.

Once the carriage assembly 14 is in the desired location along the flexi-rail 12, the lower plate 90 is raised by applying pressure to an actuator (not shown), creating an upward force on the lower plate 90 that causes the lower plate 90 to move upward. This action causes the locking lugs 94 to be received in mating holes 48 formed in the bottom surface 38. The locking lug ball-detent assembly previously described couples the locking lugs 94 to the interior of the surface surrounding the openings 48.

When the carriage assembly 14 is in place, the anchor plate 122 is coupled to carriage assembly 14 by inserting the locking lugs 76 into the key hole shaped openings 68. The carriage assembly 14 and anchor plate 122 are pneumatically secured together in the manner previously described. The pneumatic coupling is reinforced by a frictional lock formed by a pin connector (not shown). The locking pin slides down into a bore that extends between the carriage assembly 14 and the flexi-rail 12. The pin includes external threads that mate with threads supported by the bore, and as the pin is turned and tightened, the flexi-rail 12 and carriage assembly 14 are locked together.

The anchor plate 122, as illustrated in FIG. 1, supports the anchored leg 142. The robot arm manipulator 140 is coupled to the anchored leg 142 so as to extend horizontally outwardly therefrom. Finally, the foot 56 is installed on the anchored leg 142 between the leg 142 and the stay cylinder 148 to keep the leg 142 level as the carriage assembly 14 moves along the flexi-rail 12.

The carriage assembly 14 is repositioned along the flexi-rail 12 manually by platform workers using long poles. Alternatively, the carriage assembly 14 is automatically repositioned by coupling a portion of the manipulator arm 140 to the tube sheet. Flexing or moving the manipulator arm 140 causes the arm 140 to move relative to the fixed point. Since the arm 140 is movably supported by the carriage assembly 14, the movement of the arm 140 causes the carriage assembly 14 to move. This movement causes the carriage assembly 14 to roll along the flexi-rail 12 as the arm 140 is flexed and straightened. Alternatively, an electric motor coupled to the carriage assembly 14 via appropriate wiring and controls is used to move the carriage assembly 14 along the flexi-rail 12.

There are a variety of configurations that may be employed to fabricate the flexi-rail assembly 10. Thus, the disclosed embodiment is given to illustrate the invention. However, it is not intended to limit the scope and spirit of the invention. Therefore, the invention should be limited only by the appended claims.

What is claimed is:

1. An apparatus for supporting and positioning tools for inspecting a nuclear power plant steam generator, comprising:

a housing;

at least one lock assembly carried by the housing for coupling the housing to a support structure; and a carriage assembly supported by the housing for supporting and positioning inspection tools;

the lock assembly including a tubular member defining an open center and at least two openings in the surface of the tubular member;

a shaft received in the open center, the shaft defining at least two recessed surfaces, each recessed surface supporting at least one ball sized to be received in the openings defined by the tubular member, wherein a portion of each ball contacts a portion of the shaft and an adjacent external surface when received in the openings; and a cylinder supporting a movable piston coupled to the shaft for moving the shaft relative to the tubular member so as to cause the balls to be moved off each recessed surface and to be received in the opening defined by the tubular member, the cylinder being coupled to an energy source, whereby the lock couples the housing to the external surface when the balls are forced off the recessed surfaces and into the openings defined by the tubular member, wherein each ball is wedged between the shaft and the external surface.

2. The apparatus as defined in claim 1, wherein the housing includes a slight curvature.

3. The apparatus as defined in claim 1, wherein the housing supports at least one recessed surface for receiving the lock assembly.

4. The apparatus as defined in claim 1, wherein the housing includes a hollow rear portion for receiving at least one cylinder supporting a movable surface, wherein the cylinder is coupled to a source of pressurized fluid.

5. The apparatus as defined in claim 4, wherein a link couples the movable surface to the lock assembly.

6. The apparatus as defined in claim 1, wherein the housing includes a plurality of open slots for reducing the weight of the housing.

7. The apparatus as defined in claim 1, wherein the shaft is coupled to a spring for inducing a downward load on the shaft, thus forcing the balls to remain in the openings and wedged against the shaft and the external surface.

8. The apparatus as defined in claim 1, wherein the carriage assembly includes a surface supporting a means for coupling the carriage assembly to the housing.

9. The apparatus as defined in claim 1, wherein the carriage assembly includes a second surface supporting a second means for coupling the carriage assembly to the housing.

10. The apparatus as defined in claim 1, wherein the carriage assembly includes a third surface supporting a means for coupling the carriage assembly to the housing.

11. The apparatus as defined in claim 1, wherein the apparatus further includes a foot supported by an anchored leg carried by the flexi-rail assembly, whereby the foot keeps the leg level during inspection of a steam generator.

12. An apparatus for supporting and positioning tools for inspecting a nuclear power plant steam generator, comprising:

a housing;

at least one lock assembly carried by the housing for coupling the housing to a support structure; and a carriage assembly supported by the housing for supporting and positioning inspection tools;

the carriage assembly including a first surface supporting a plurality of outwardly projecting cylindrical members for coupling the carriage assembly to the housing;

a second surface carried by the first surface, the second surface supporting a plurality of cylindrical members for coupling the carriage assembly to the housing; and a third surface movable relative to the second surface, the third surface supporting a locking assembly for securing the third surface to the housing.

13. The apparatus as defined in claim 12, wherein the locking assembly includes:

a plurality of tubular members retained in a block housing, the tubular members being coupled to a source of pressurized fluid; and a ball-detent system retained by each tubular member, including:

a tubular member defining an open center and at least two openings in the surface of the tubular member; and a shaft received in the open center, the shaft defining at least two recessed surfaces, each recessed surface supporting at least one ball sized to be received in the openings defined by the tubular member, wherein a portion of each ball contacts a portion of the shaft and the housing when received in the openings, whereby the locking assembly couples the carriage assembly to the housing when the balls are forced off the recessed surfaces and into the openings defined by the tubular member, wherein each ball is wedged between the shaft and the housing.

14. The apparatus as defined in claim 12, wherein the third surface is coupled to a source of pressurized fluid, wherein the pressurized fluid, when received by the third surface, causes the third surface to move upward in the direction of the second surface.

15. An apparatus for supporting and positioning tools for inspecting a nuclear power plant steam generator, comprising:

a housing having a slightly curved surface;

at least one tube lock assembly carried by the housing for coupling the housing to a tube sheet, the tube lock assembly including:

a tubular member defining an open center and at least two openings in the surface of the tubular member; and a shaft received in the open center, the shaft defining at least two recessed surfaces, each recessed surface supporting at least one ball sized to be received in the openings defined by the tubular member, wherein a portion of each ball contacts a portion of the shaft and an adjacent surface of the tube sheet when received in the openings, whereby the lock couples the housing to the tube sheet when the balls are forced off the recessed surfaces and into the openings defined by the tubular member, wherein each ball is wedged between the shaft and the adjacent surface of the tube sheet surface; and a carriage assembly movably supported by the housing for supporting and positioning inspection tools, including:

a first surface supporting a plurality of outwardly projecting cylindrical members for coupling the carriage assembly to the housing;

a second surface carried by the first surface, the second surface supporting a plurality of cylindrical members for coupling the carriage assembly to the housing; and a third surface movable relative to the second surface, the third surface supporting a locking assembly for securing the third surface to the housing.

16. The apparatus as defined in claim 15, wherein the locking assembly includes:

a plurality of tubular members retained in a block housing, the tubular members being coupled to a source of pressurized fluid; and a ball-detent system retained by each tubular member, including:

a tubular member defining an open center and at least two openings in the surface of the tubular member; and a shaft received in the open center, the shaft defining at least two recessed surfaces, each recessed surface supporting at least one ball sized to be received in the openings defined by the tubular member, wherein a portion of each ball contacts a portion of the shaft and the housing when received in the openings, whereby the locking assembly couples the carriage assembly to the housing when the balls are forced off the recessed surfaces and into the openings defined by the tubular member, wherein each ball is wedged between the shaft and the housing.

17. The apparatus as defined in claim 15, wherein the third surface is coupled to a source of pressurized fluid, whereby the surface moves upward when the pressure source is activated.

18. The apparatus as defined in claim 15, wherein the apparatus is fabricated primarily of aluminum.

19. The apparatus as defined in claim 18, wherein some components of the apparatus are made of stainless steel.

* * * * *